US010304416B2

(12) United States Patent
Li et al.

(10) Patent No.: US 10,304,416 B2
(45) Date of Patent: May 28, 2019

(54) DISPLAY OVERDRIVE SYSTEMS AND METHODS

(71) Applicant: Apple Inc., Cupertino, CA (US)

(72) Inventors: Xiaokai Li, Sunnyvale, CA (US); Young Cheol Yang, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/700,045

(22) Filed: Sep. 8, 2017

(65) Prior Publication Data

US 2019/0035366 A1 Jan. 31, 2019

Related U.S. Application Data

(60) Provisional application No. 62/538,588, filed on Jul. 28, 2017.

(51) Int. Cl.
*G09G 5/38* (2006.01)
*G09G 5/36* (2006.01)

(52) U.S. Cl.
CPC ..... *G09G 5/38* (2013.01); *G09G 5/363* (2013.01); *G09G 2320/0252* (2013.01); *G09G 2340/16* (2013.01)

(58) Field of Classification Search
CPC .... G06F 3/011; G09G 3/2051; G09G 3/3611; G09G 2300/0408; G09G 5/06; G09G 5/02; G09G 5/395; G09G 2340/10; G09G 2320/0666; G09G 5/001; G09G 2320/0276; H04N 1/00; G06T 11/001
See application file for complete search history.

(56) References Cited

U.S. PATENT DOCUMENTS

| | | | | |
|---|---|---|---|---|
| 7,382,349 | B1 | 6/2008 | Kuhns | |
| 7,696,988 | B2 | 4/2010 | Wu et al. | |
| 7,701,451 | B1 * | 4/2010 | Daewon | G09G 3/2096 345/204 |
| 7,777,707 | B2 | 8/2010 | Halfant | |
| 7,804,470 | B2 | 9/2010 | Poon | |
| 8,711,072 | B2 | 4/2014 | Warmuth et al. | |
| 9,390,663 | B2 * | 7/2016 | Schutten | G09G 3/36 |
| 2007/0063956 | A1 * | 3/2007 | Jong | G09G 3/3648 345/98 |
| 2007/0126678 | A1 * | 6/2007 | Shih | G09G 3/342 345/89 |
| 2009/0262124 | A1 * | 10/2009 | Yamamoto | G09G 3/3611 345/565 |
| 2013/0194313 | A1 | 8/2013 | Yang et al. | |

* cited by examiner

*Primary Examiner* — Todd Buttram

(74) *Attorney, Agent, or Firm* — Jaffery Watson Mendonsa & Hamilton LLP

(57) ABSTRACT

Aspects of the subject technology relate to display circuitry including pixel overdrive circuitry. The pixel overdrive circuitry includes one more lookup tables of boost values to be applied to pixel display values of a frame to be displayed, for overdrive of that frame. Each lookup table includes a lightness-blur-edge-width-based boost value. The lightness-blur-edge-width-based boost value matches a lightness-blur-edge-width of an intermediate grey-to-grey transition to a lightness-blur-edge-width of a maximum grey-to-grey transition.

29 Claims, 5 Drawing Sheets

DISPLAY OVERDRIVE SYSTEMS AND METHODS

CROSS-REFERENCE TO RELATED APPLICATIONS

The present application claims the benefit of U.S. Provisional Patent Application Ser. No. 62/538,588, entitled "DISPLAY OVERDRIVE SYSTEMS AND METHODS," filed on Jul. 28, 2017, which is hereby incorporated by reference in its entirety for all purposes.

TECHNICAL FIELD

The present description relates generally to electronic devices with displays, and more particularly, but not exclusively, to pixel overdrive systems and methods for electronic device displays.

BACKGROUND

Electronic devices such as computers, media players, cellular telephones, set-top boxes, and other electronic equipment are often provided with displays for displaying visual information. Displays such as organic light-emitting diode (OLED) displays and liquid crystal displays (LCDs) typically include an array of display pixels arranged in pixel rows and pixel columns. Liquid crystal displays commonly include a backlight unit and a liquid crystal display unit with individually controllable liquid crystal display pixels.

When time-varying content such as video content or user-modified content is displayed, particularly content in which particular pixel brightnesses vary between grey levels from display frame to display frame, undesirable visible display artifacts can arise.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
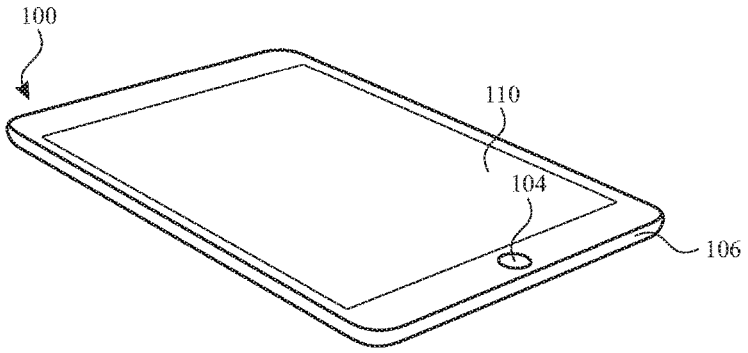
FIG. 1 illustrates a perspective view of an example electronic device having a display in accordance with various aspects of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject disclosure provides electronic devices such as cellular telephones, media players, computers, set-top boxes, wireless access points, and other electronic equipment that may include displays. Displays are used to present visual information and status data and/or may be used to gather user input data. A display includes an array of display pixels. Each display pixel may include one or more colored subpixels for displaying color images. For example, each display pixel may include a red subpixel, a green subpixel, and blue subpixel. It should be appreciated that, although the description that follows often describes operations associated with a display pixel, in implementations in which each display pixel includes multiple subpixels, the circuitry and operations described herein can be applied and/or performed, per color, for each subpixel of the display pixel.

Each display pixel may include a layer of liquid crystals disposed between a pair of electrodes operable to control the orientation of the liquid crystals. Controlling the orientation of the liquid crystals by modifying a voltage difference across the electrodes controls the polarization of backlight. This polarization control, in combination with polarizers on opposing sides of the liquid crystal layer, allows light passing into the pixel to be manipulated to selectively block the light or allow the light to pass through the pixel.

Digital grey levels for operating display pixels can have associated values from, for example, 0 to 255 (sometimes denoted as GL0 and GL255 for convenience). Due to properties inherent in liquid crystals, although a change from a grey level of zero to a grey level of 255 can be achieved relatively quickly by applying a voltage corresponding to the 255 grey level to the pixel, a change from, for example, 0 to 127 can occur slowly enough to have visible effects on the display.

Changing content on the display that includes various grey-to-grey transitions can therefore cause visual artifacts such as motion blur. Additionally, for color displays, the grey level, and the grey-to-grey transitions for changing content, can be different for differently colored display pixels or subpixels. For this reason, the changes in brightness for different colors can occur on different time scales, which can cause undesirable color errors such as a color tail at the edge of moving display content. To some users, a separation of the color changes causing a color tail can be even more visually unpleasant than motion blur.

In some scenarios, motion blur is addressed by overdriving some pixels briefly beyond their target grey level (e.g., for a single display frame) to accelerate the transition to the target grey level and luminance level. Each pixel is overdriven to an overdrive grey level that is determined based on a measured response time of the pixel for each grey-to-grey transition. This type of overdrive correction, based on pixel response time alone, can be effective for reducing motion blur, but can still allow visible color tails, as this response-time type of correction does not account for the human eye's response to changing brightness and/or moving edges. For example, this type of response-time-based correction can change the color of the color tail (e.g., from a red color tail to an overdriven green color tail) without sufficiently reducing or eliminating the color tail.

In accordance with some aspects of the subject disclosure, which are described in further detail hereinafter, systems and methods for overdriving display pixels are provided. The overdrive operations described herein include overdrive values that are based on a lightness blur edge width (LBEW) and/or a blur edge width (BEW) as described in further detail hereinafter. For example, in some operational scenarios, the LBEW is used to determine an overdrive value for pixels with increasing brightness (e.g., for a transition from a current grey level to a higher target grey level) and BEW is used for pixels with decreasing brightness (e.g., for a transition from a current grey level to a lower target grey level). The overdrive values are arranged to modify the LBEW and/or the BEW associated with each grey-to-grey transition, which can help match the LBEW and/or the BEW of different colored subpixels. In this way, an overdrive correction can be applied that reduces or eliminates visible motion blur and color tailing by applying a correction that accounts for both the pixel response and the human perception of moving content. The human perception of moving content includes the tendency for the human eye to follow a moving edge as described by a human vision pursuit model.

Overdrive levels (sometimes referred to herein a boost values) for each of several measured grey-to-grey transitions can be stored in a lookup table, the values of which can be used directly and/or interpolated to select an overdrive value for each colored subpixel of each pixel for each grey-to-grey transition. Because displays can operate at various frequencies (e.g., frequencies of 48 Hz, 60 Hz, 80 Hz, or 120 Hz), one or more lookup tables of overdrive values based on LBEW and/or BEW can be provided for each display frequency of a particular display. Because pixel response times can be temperature dependent, lookup tables, each based on the LBEW and/or BEW, may be provided for various display temperatures at each display frequency.

In some operational scenarios, during operation of the display, (i) a set of lookup tables associated with the current display frequency is identified, (ii) the display temperature is estimated (e.g., based on the operational history of the display and factory calibration information for that display or that type of display) or measured (e.g., using a temperature sensor on the display) and, (iii.a) an appropriate lookup table for that temperature may be used from which to select individual pixel overdrive levels, or (iii.b) pixel overdrive levels may be determined by an interpolation of pixel overdrive levels in multiple temperature-specific lookup tables.

An illustrative electronic device having a display is shown in FIG. 1. In the example of FIG. 1, device 100 has been implemented using a housing that is sufficiently small to be portable and carried by a user (e.g., device 100 of FIG. 1 may be a handheld electronic device such as a tablet computer or a cellular telephone). As shown in FIG. 1, device 100 includes a display such as display 110 mounted on the front of housing 106. Display 110 may be substantially filled with active display pixels or may have an active portion and an inactive portion. Display 110 may have openings (e.g., openings in the inactive or active portions of display 110) such as an opening to accommodate button 104 and/or other openings such as an opening to accommodate a speaker, a light source, or a camera.

Display 110 may be a touch screen that incorporates capacitive touch electrodes or other touch sensor components or may be a display that is not touch-sensitive. Display 110 includes display pixels formed from light-emitting diodes (LEDs), organic light-emitting diodes (OLEDs), plasma cells, electrophoretic display elements, electrowetting display elements, liquid crystal display (LCD) components, or other suitable display pixel structures. Arrangements in which display 110 is formed using LCD pixels and LED backlights are sometimes described herein as an example. This is, however, merely illustrative. In various implementations, any suitable type of display technology may be used in forming display 110 if desired.

Housing 106, which may sometimes be referred to as a case, may be formed of plastic, glass, ceramics, fiber composites, metal (e.g., stainless steel, aluminum, etc.), other suitable materials, or a combination of any two or more of these materials.

The configuration of electronic device 100 of FIG. 1 is merely illustrative. In other implementations, electronic device 100 may be a computer such as a computer that is integrated into a display such as a computer monitor, a laptop computer, a somewhat smaller portable device such as a wrist-watch device, a pendant device, or other wearable or miniature device, a media player, a gaming device, a navigation device, a computer monitor, a television, or other electronic equipment.

For example, in some implementations, housing 106 may be formed using a unibody configuration in which some or all of housing 106 is machined or molded as a single structure or may be formed using multiple structures (e.g., an internal frame structure, one or more structures that form exterior housing surfaces, etc.). Although housing 106 of FIG. 1 is shown as a single structure, housing 106 may have multiple parts. For example, housing 106 may have upper portion and lower portion coupled to the upper portion using a hinge that allows the upper portion to rotate about a rotational axis relative to the lower portion. A keyboard such as a QWERTY keyboard and a touch pad may be mounted in the lower housing portion, in some implementations.

In some implementations, electronic device 100 may be provided in the form of a computer integrated into a computer monitor. Display 110 may be mounted on a front surface of housing 106 and a stand may be provided to support housing (e.g., on a desktop).

Figure 2:
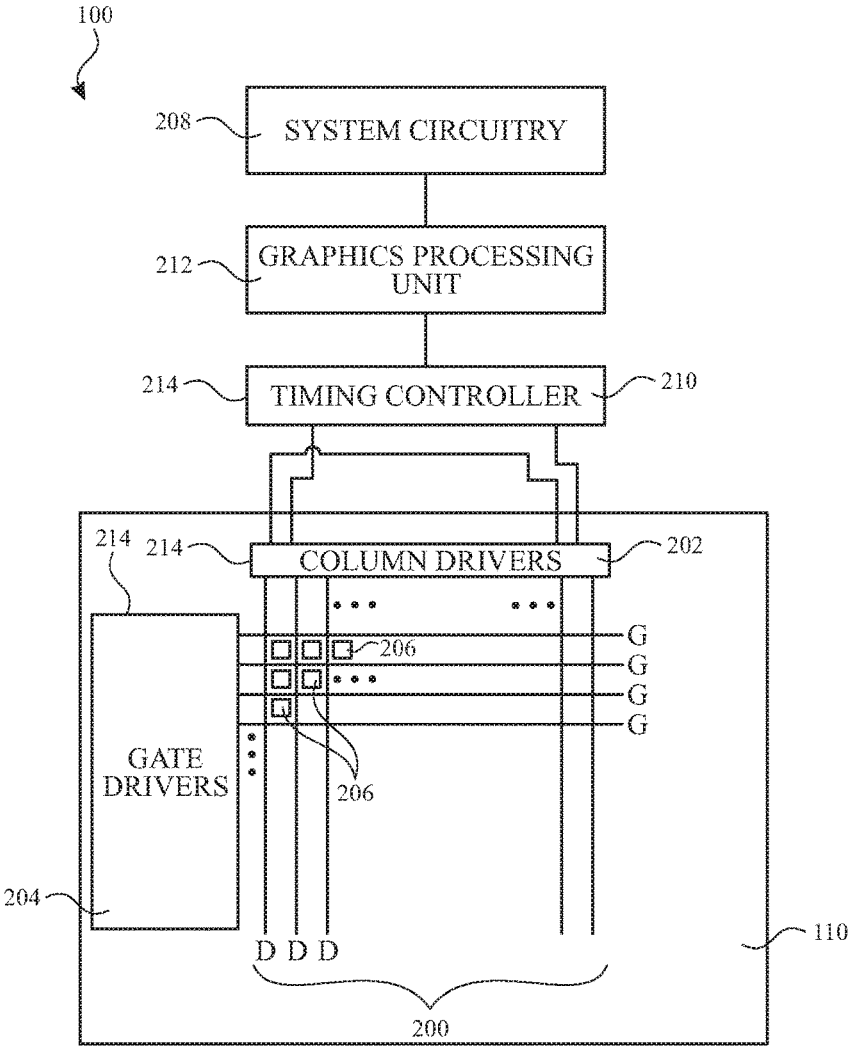
FIG. 2 illustrates a schematic diagram of exemplary display circuitry in accordance with various aspects of the subject technology.

FIG. 2 is a schematic diagram of device 100 showing illustrative circuitry that may be used in displaying images for a user of device 100 on pixel array 200 of display 110. As shown in FIG. 2, display 110 may include column driver circuitry 202 that drives data signals (analog voltages) onto the data lines D of array 200. Gate driver circuitry 204 may drive gate line signals onto gate lines G of array 200.

Using the data lines D and gate lines G, display pixels 206 may be operated to display images on display 110 for a user. In some implementations, gate driver circuitry 204 may be implemented using thin-film transistor circuitry on a display substrate such as a glass or plastic display substrate or may be implemented using integrated circuits that are mounted on the display substrate or attached to the display substrate by a flexible printed circuit or other connecting layer. In some implementations, column driver circuitry 202 may be implemented using one or more column driver integrated circuits that are mounted on the display substrate or using column driver circuits mounted on other substrates.

Device 100 may include system circuitry 208. System circuitry 208 may include one or more different types of storage such as hard disk drive storage, nonvolatile memory (e.g., flash memory or other electrically-programmable-read-only memory), volatile memory (e.g., static or dynamic random-access-memory), magnetic or optical storage, permanent or removable storage and/or other non-transitory storage media configure to store static data, dynamic data, and/or computer readable instructions for processing circuitry in system circuitry 208. Processing circuitry in system circuitry 208 may be used in controlling the operation of device 100. Processing circuitry in system circuitry 208 may sometimes be referred to herein as system circuitry or a system-on-chip (SOC) for device 100.

The processing circuitry may be based on a processor such as a microprocessor and other suitable integrated circuits, multi-core processors, one or more application specific integrated circuits (ASICs) or field programmable gate arrays (FPGAs) that execute sequences of instructions or code, as examples. In one suitable arrangement, system circuitry 208 may be used to run software for device 100, such as internet browsing applications, email applications, media playback applications, operating system functions, software for capturing and processing images, software implementing functions associated with gathering and processing sensor data, software that makes adjustments to display brightness and touch sensor functionality, etc.

During operation of device 100, system circuitry 208 may produce data that is to be displayed on display 110. This display data may be provided to display control circuitry such as graphics processing unit (GPU) 212. For example display frames, including display pixel values (e.g., each corresponding to a grey level) for display using pixels 206 (e.g., colored subpixels such as red, green, and blue subpixels) may be provided from system circuitry 208 to GPU 212. GPU 212 may process the display frames and provide processed display frames to timing controller integrated circuit 210.

Timing controller 210 may provide digital display data (e.g., the pixel values each corresponding to a grey level for display) to column driver circuitry 202 using paths 216. Column driver circuitry 202 may receive the digital display data from timing controller 210. Using digital-to-analog converter circuitry within column driver circuitry 202, column driver circuitry 202 may provide corresponding analog output signals on the data lines D running along the columns of display pixels 206 of array 200.

Graphics processing unit 212 and timing controller 210 may sometimes collectively be referred to herein as display control circuitry 214. Display control circuitry 214 may be used in controlling the operation of display 110. Display control circuitry 214 may sometimes be referred to herein as a display driver, a display controller, a display driver integrated circuit (IC), or a driver IC. Graphics processing unit 212 and timing controller 210 may be formed in a common package (e.g., an SOC package) or may be implemented separately (e.g., as separate integrated circuits). In some implementations, timing controller 210 may be implemented separately as a display driver, a display controller, a display driver integrated circuit (IC), or a driver IC that receives processed display data from graphics processing unit 212. Accordingly, in some implementations, graphics processing unit 212 may be considered to be part of the system circuitry (e.g., together with system circuitry 208) that provides display data to the display control circuitry (e.g., implemented as timing controller 210, gate drivers 204, and/or column drivers 202). Although a signal gate line G and a single data line D for each pixel 206 are illustrated in FIG. 2, this is merely illustrative and one or more additional row-wise and/or column-wise control lines may be coupled to each pixel 206 in various implementations.

Figure 3:
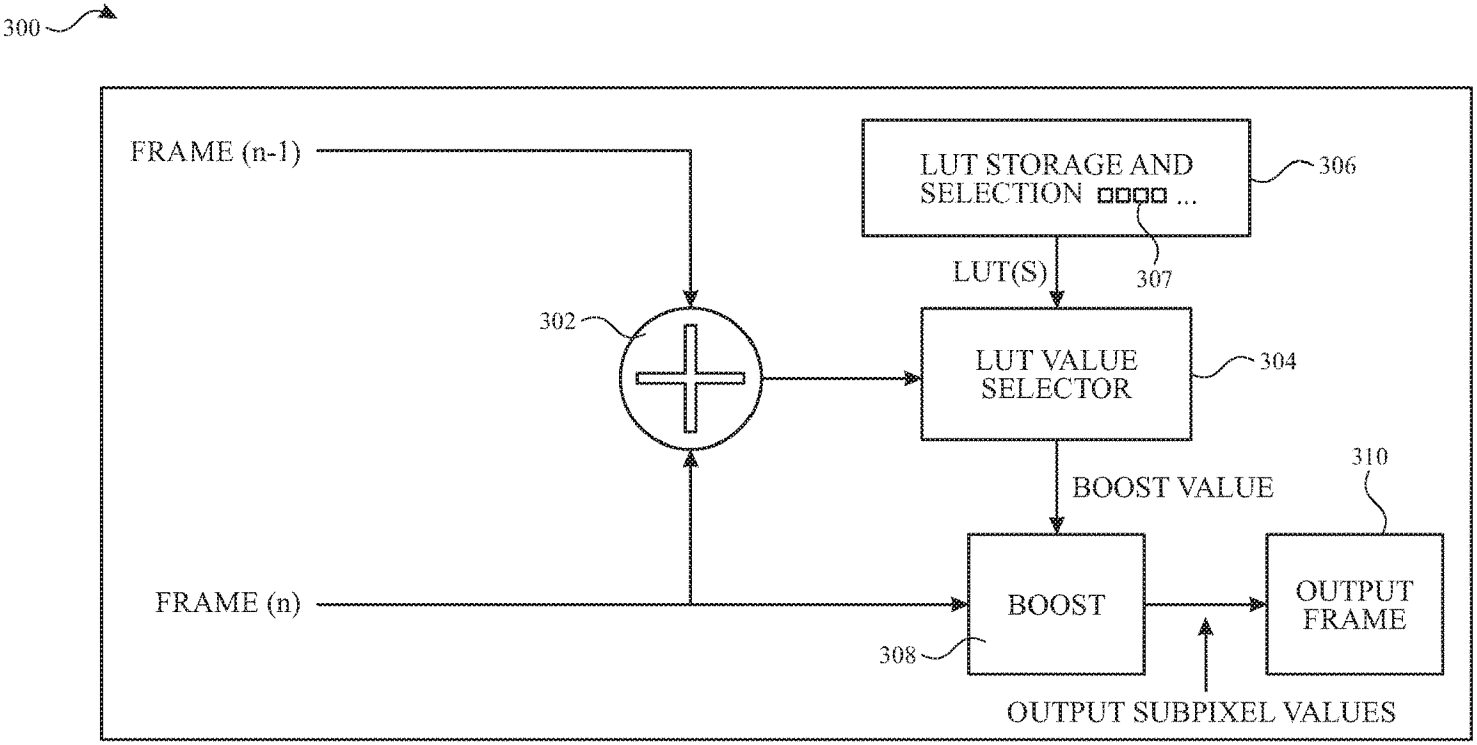
FIG. 3 illustrates a flow diagram for pixel overdrive circuitry in accordance with various aspects of the subject technology.

Graphics processing unit 212 and/or system circuitry 208 includes pixel overdrive circuitry, sometimes referred to as display overdrive circuitry or overdrive circuitry. One example implementation of pixel overdrive circuitry that may be implemented in, for example, GPU 212 is shown in FIG. 3. As shown in FIG. 3, pixel overdrive circuitry 300 includes comparator 302, lookup table (LUT) value selector 304, LUT storage and selection engine 306, and boost engine 308.

As shown, LUT storage and selection engine 306 stores one or more lookup tables 307. Lookup tables 307 each store overdrive levels, also referred to herein as boost values, for each of several grey-to-grey transitions from a start grey level of a previous frame (sometimes referred to herein as frame n−1, where n is an integer frame number) to an arrival grey level of a current, nth frame. Each lookup table 307 is specific to a particular frequency and a particular temperature for display 110.

LUT storage and selection engine 306 provides a selected lookup table $LUT_s$ to LUT value selector 304. LUT value selector 304 also receives a difference, between the start grey level (e.g., the subpixel value for the previous frame n−1) and the arrival grey level (e.g., the subpixel value for the current frame n). Based on the received difference and the start grey level and/or the arrival grey level, LUT value selector 304 obtains a boost value to be applied to the subpixel value of the current frame (n). LUT value selector 304 may obtain the boost value by selecting a boost value directly from the table (if the specific difference or grey-to-grey transition is included in the table), or may combine (e.g., interpolate) several values in the table to obtain the boost value. LUT value selector 304 provides the boost value to boost engine 308, which also receives the current frame subpixel value. Boost engine 308 applies (e.g., adds) the boost value to the current frame subpixel value to form a subpixel value of an output frame 310 to be displayed.

Although circuitry 300 of FIG. 3 shows a comparator 302 which provides a frame difference for each subpixel to LUT value selector 304, this is merely illustrative. In other examples, LUT value selector 304 receives the actual subpixel values (e.g., the start and arrival grey levels for each subpixel) and obtains the boost value based on the start and arrival grey levels.

The boost values or overdrive levels in each LUT are based on a lightness blur edge width (LBEW) and/or a blur edge width (BEW). More particularly, the boost values are arranged to match, as closely as possible without generating other display artifacts such as overshoot or undershoot luminance artifacts, the LBEW and/or BEW for each grey-to-grey transition (e.g., to a target LBEW and/or BEW).

Figure 4:
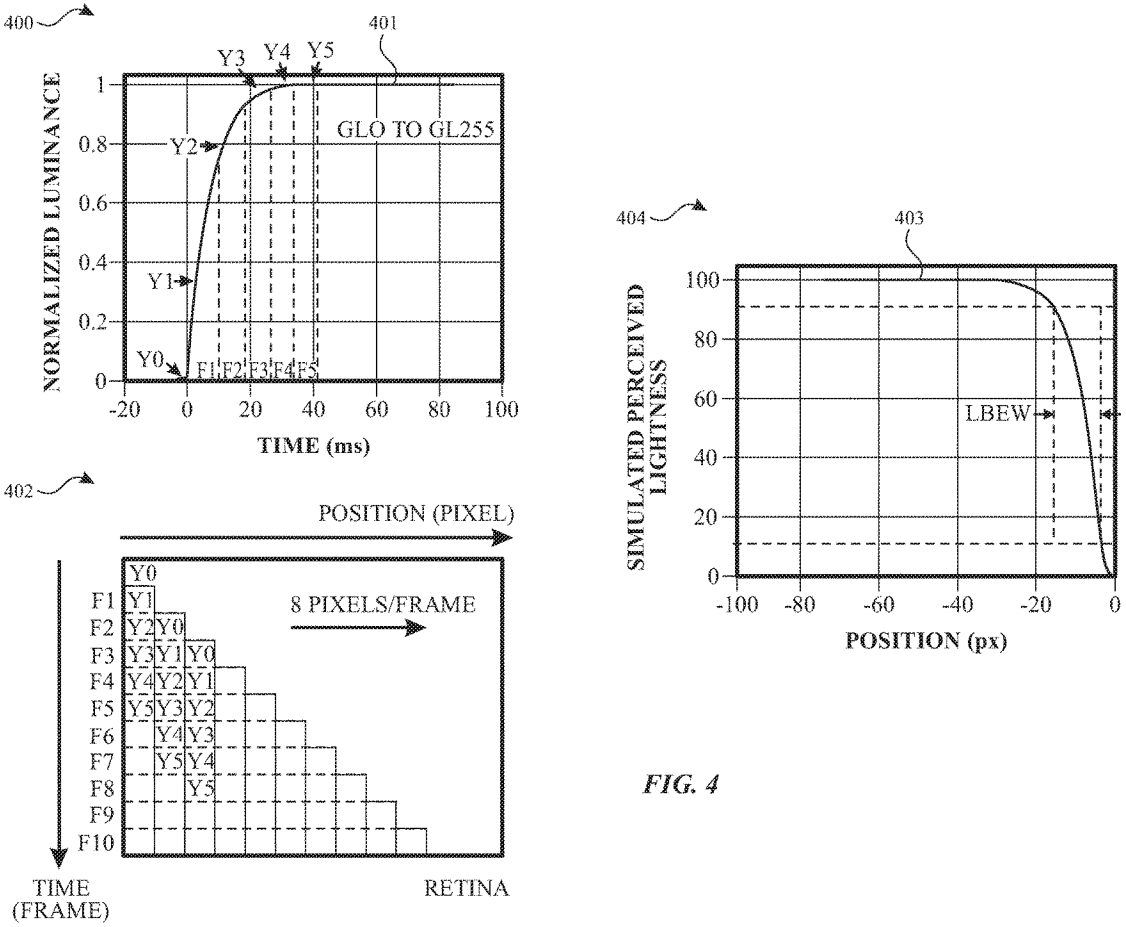
FIG. 4 illustrates a lightness blur edge width in accordance with various aspects of the subject technology.

Various aspects of an LBEW are shown in FIG. 4, for an exemplary frequency and an exemplary moving speed (e.g., a moving speed of eight pixels per frame). It should be appreciated that the specific values and curves in FIG. 4 are illustrative and can also be generated for different frequencies and/or moving speeds. FIG. 4 includes a first graph 400 which shows the luminance of an exemplary display subpixel over time following a change of an applied subpixel value from a grey level of zero (GL0) to a grey level of 255 (GL255).

Various luminance sections Y0, Y1, Y2, Y3, Y4, and Y5 are indicated during the increase in pixel luminance after application of the arrival grey level of GL255. Each of luminance sections Y0, Y1, Y2, Y3, Y4, and Y5 may be an array of values that contains several luminance values from within a corresponding frame. For example, luminance sections Y1, Y2, Y3, Y4, and Y5 may be arrays of values that represent the luminance change within the respective first, second, third, fourth and fifth frame times F1, F2, F3, F4, and F5.

FIG. 4 also shows a graph 402 that indicates a human retinal response to a display, with content according to curve 401 moving at eight pixels per frame over the course of ten display frames F1 through F10 (including frame times F1, F2, F3, F4, and F5 of graph 400). The luminance sections Y0, Y1, Y2, Y3, Y4, and Y5 of curve 401 are indicated in graph 402. Graph 402 is calculated from curve 401 based on a human vision pursuit model, which accounts for the human eye's tendency to follow a moving edge.

Based on the retinally perceived luminance changes in graph 402, a perceived spatial luminance curve is obtained according to the spatial luminance changes across graph 402. Based on the determined perceived luminance curve, lightness curve 403 is obtained which, as shown in graph 404 of FIG. 4, indicates the retinally perceived spatial lightness (in pixels) about a moving edge on an electronic device display. The lightness curve 403 is the cube root of the determined luminance curve.

The transition region from light (100) to dark (0) on spatial curve 403 represents the blur of a moving edge as perceived by a human eye. The spatial width of the transition region from light to dark on curve 403 is characterized by a blur-width that is sometimes referred to herein as a lightness blur edge width (LBEW), which is shown as the pixel width of the transition region between the $90^{th}$ percentile of lightness to the $10^{th}$ percentile of brightness (although other percentiles can be chosen if desired). This pixel width corresponds to a spatial lightness width associated with a moving edge for display with the pixels of display 110. Although the LBEW in FIG. 4 is measured in pixels, the LBEW can also be expressed in other units. For example, the LBEW can be expressed in degrees by converting pixels to an angle based on a viewing display angle and a known number of display pixels per inch. As another example, the LBEW can be expressed in frames using normalized pixels moving at a speed of N pixels/frame.

Because the grey levels for different colored subpixels can be different, the LBEW of each colored subpixel can be different. Accordingly, for a moving edge on a color electronic device display, the colors can visibly separate, which creates the visible artifact referred to herein as a color tail. As described herein, the color tail can be reduced or eliminated by overdriving or boosting to attempt to match the LBEW and/or BEW of intermediate grey-to-grey transitions to a target LBEW and/or BEW (e.g., the LBEW of BEW of a maximum grey-to-grey transition), which can help ensure that the LBEW of each color is substantially the same or at least more similar. As described herein, one or more lookup tables of LBEW-based boost values are provided and applied during operation of an electronic device display, where the LBEW-based boost values modify the LBEW of the various colored subpixels to more closely match.

It has also been discovered that the human-perceived response to moving edges on an electronic device display can be characterized differently for rising luminance changes and falling luminance changes. In accordance with some aspects of the disclosure, the LBEW-based boost values may be used for rising luminance changes and other boost values may be used for falling luminance changes. For example, the boost values (e.g., the boost values in the lookup table) for falling luminance changes may be BEW-based boost values that are based on a another spatial blur width, sometimes referred to herein as a brightness edge width (BEW), which is associated with the luminance rather than the lightness.

For example, based on an empirically determined pixel luminance response curve 401 for a falling luminance from GL255 to GL0, another graph 402 can be obtained that indicates a human retinal response to a display, with content, according to the falling luminance curve, moving at (for example) eight pixels per frame over the course of ten display frames F1 through F10 (including frame times F1, F2, F3, F4, and F5 of graph 400).

Based on the retinally perceived luminance changes in a falling luminance graph 402, a perceived spatial luminance curve is obtained according to the spatial luminance changes across that graph 402. The transition region from dark (0) to light (100) of the perceived luminance curve represents the blur of a moving edge as perceived by a human eye for a falling luminance in time. The spatial width of the transition region from dark to light on the perceived luminance curve is characterized by the blur width referred to herein as the blur edge width (BEW), which is the pixel width of the transition region between the $10^{th}$ percentile of lightness to the $90^{th}$ percentile of brightness (although other percentiles can be chosen if desired). This pixel width corresponds to a spatial luminance width associated with a moving edge for display with the pixels of display 110

Figure 5:
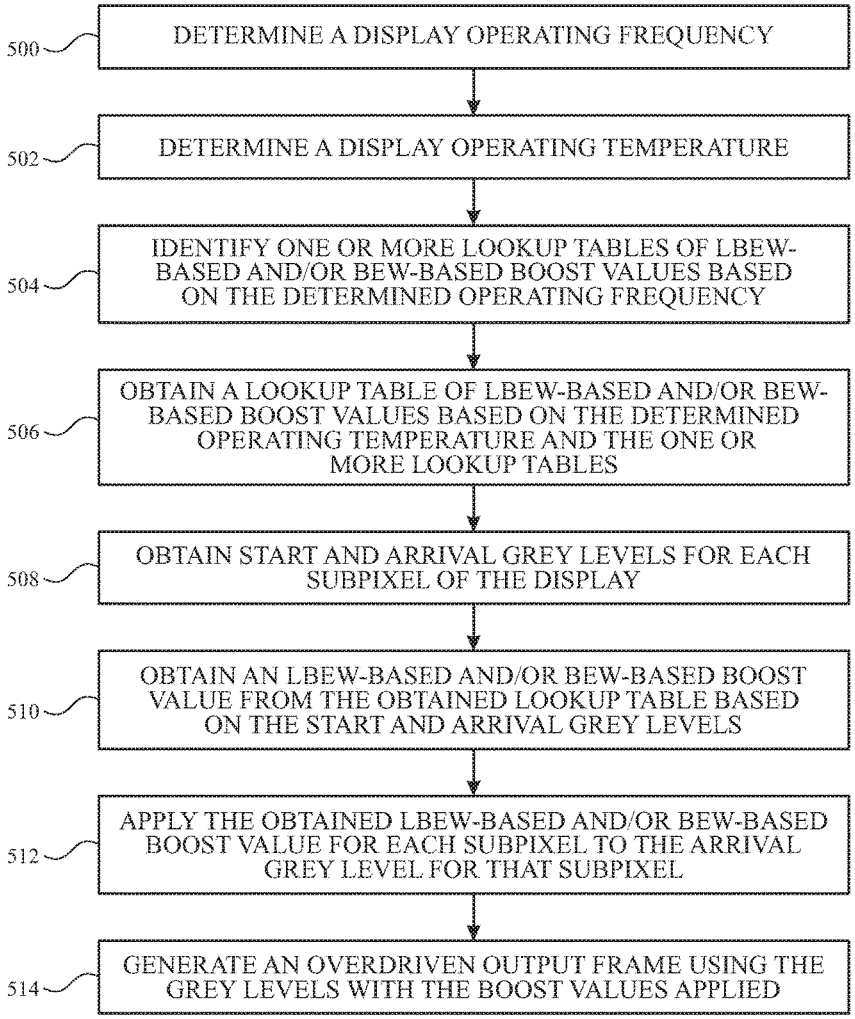
FIG. 5 illustrates a flow chart of illustrative operations for display pixel overdrive in accordance with various aspects of the subject technology.

FIG. 5 depicts a flow diagram of an example process for pixel overdrive operations for electronic device displays in accordance with various aspects of the subject technology. For explanatory purposes, the example process of FIG. 5 is described herein with reference to the components of FIGS. 1-4. Further for explanatory purposes, the blocks of the example process of FIG. 5 are described herein as occurring in series, or linearly. However, multiple blocks of the example process of FIG. 5 may occur in parallel. In addition, the blocks of the example process of FIG. 5 need not be performed in the order shown and/or one or more of the blocks of the example process of FIG. 5 need not be performed.

In the depicted example flow diagram, at block 500, the operating frequency of the display (e.g., display 110) may be determined. For example, overdrive circuitry 300 may receive an indication of the operating frequency from other portions of the display control circuitry or the display control circuitry may determine the operating frequency of the previous frame. The operating frequency of the display may be, for example, 48 Hz, 60 Hz, 80 Hz, or 120 Hz.

At block 502, an operating temperature of the display may be determined. Determining the operating temperature of the display may include obtaining a measured temperature of a substrate of the display from a temperature sensor (e.g., a thermistor) mounted on the substrate or otherwise thermally coupled to the substrate or may include estimating the operating temperature of the display based on an operating history of the display (e.g., a length of time during which the display has been operating and/or a history of the content displayed on the display during a current operating period) and based on calibration information (e.g., a temperature/history correlation measured during manufacturing) stored by the display control circuitry or other circuitry of the device.

At block 504, one or more stored lookup tables of LBEW-based or BEW-based boost values, as described herein, may be identified based on the determined operating frequency. For example, boost control circuitry 300 may store multiple lookup tables 307, including at least one corresponding to each operational frequency for the display. The lookup tables 307 for each operational frequency may include multiple lookup tables, each corresponding to an operating temperature of the display at that frequency. Identifying the lookup tables based on the determined operating frequency may include identifying a stored subset of a stored set of lookup tables, the subset corresponding to multiple operating temperatures at that frequency.

At block 506, a lookup table of LBEW-based or BEW-based boost values, as described herein, may be obtained based on the determined operating temperature. Obtaining the lookup table based on the operating temperature may include selecting one of the identified subset of lookup tables that corresponds (e.g., within a small temperature window) to the determined operating temperature or may include generating a new lookup table for the operating temperature by interpolating the values of two or more of the subset of lookup tables at other operating temperatures.

At block 508, start and arrival grey levels for each subpixel of the display are obtained. The start grey level for each subpixel is a subpixel value for a previous display frame (e.g., a display frame that has been drawn on the display) and the arrival grey level is a subpixel value of that particular subpixel for a current display frame (e.g., the next frame to be displayed).

At block 510, an LBEW-based and/or BEW-based boost value is obtained from the obtained lookup table, based on the start and arrival grey levels (e.g., based on the grey levels themselves and/or based on a difference between the start and arrival grey levels). Obtaining the LBEW-based and/or BEW-based boost value from the obtained lookup table may include selecting a boost value associated with the start and arrival grey levels from the lookup table or interpolating or otherwise combining multiple boost values associated with nearby start and/or arrival grey levels from the lookup table.

At block 512, the obtained LBEW-based and/or BEW-based boost value for each subpixel is applied to the arrival grey level for that subpixel. Applying the boost value may include adding the boost value to the arrival grey level to generate an overdriven pixel value.

At block 514, an overdriven output frame is generated using the overdriven pixel value with the boost values applied. The display pixels (e.g., pixels 206 of FIG. 2) of the display are then illuminated using the overdriven output frame, followed by one or more frames including the arrival grey levels without boosting. In this way, the display pixels are driven to the desired arrival grey levels more quickly by application of the overdriven output frame.

Figure 6:
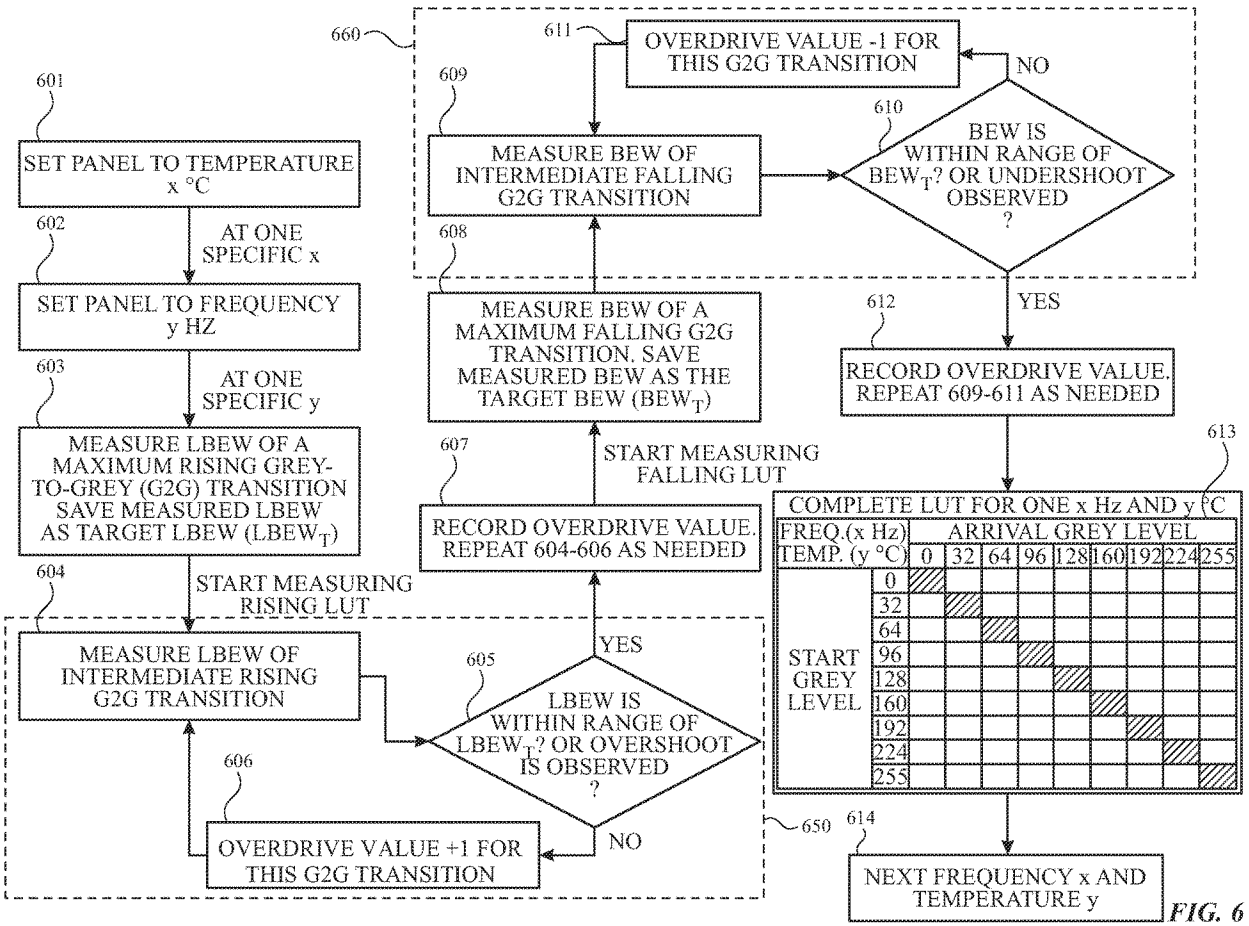
FIG. 6 illustrates a flow diagram for generating lookup tables having lightness-blur-edge-width-based and/or blur-edge-width-based boost values in accordance with various aspects of the subject technology.

FIG. 6 depicts a flow diagram of an example process for generating LBEW and/or BEW lookup tables for pixel overdrive operations for electronic device displays in accordance with various aspects of the subject technology. The operations of FIG. 6 may be performed during manufacturing operations for electronic device 100 and/or display 110 (e.g., during factory calibration operations) using, for example, calibration equipment such as one or more light sensors (e.g., photodiodes) and processing circuitry for generating, storing, and processing calibration data. For explanatory purposes, the example process of FIG. 6 is described herein with reference to the components of FIGS. 1-4. Further for explanatory purposes, the blocks of the example process of FIG. 6 are described herein as occurring in series, or linearly. However, multiple blocks of the example process of FIG. 6 may occur in parallel. In addition, the blocks of the example process of FIG. 6 need not be performed in the order shown and/or one or more of the blocks of the example process of FIG. 6 need not be performed.

In the depicted example flow diagram, at block 600, the display (panel) is set to operate at a selected frequency, noted in FIG. 6 as a frequency of x Hz (e.g., 120 Hz, 80 Hz, 60 Hz, or 48 Hz).

At block 602, the display (panel) is set to an operating temperature of y degrees Centigrade (° C.). Setting the operating temperature may include operating the display at the desired frequency until the display reaches the desired operating temperature and/or applying heat from an external heat source to the display panel until the display reaches the desired operating temperature.

At block 603, a blur width such as the LBEW of a maximum rising grey-to-grey transition such as the GL0 to GL255 transition, for one or more subpixels, is measured while operating the display at a frequency of x Hz and at a temperature of y° C. The measured LBEW of the GL0 to GL255 transition is then saved as the target LBEW ($LBEW_t$). The LBEW of the GL0 to GL255 transition may be measured using a single pixel, a single subpixel, a group of contiguous or non-contiguous pixels that form a subset of the array of display pixels, or the entire array of pixels. Measuring the LBEW may include applying the first grey level value (GL0) to the one or more pixels or subpixels, then applying the second grey level value (GL255) to the same one or more pixels and measuring the luminance response curve (e.g., see curve 401 of FIG. 4) using a photodiode or other sensor. From the measured luminance response curve, a graph such as graph 402 of FIG. 4 may be generated. Based on the graph 402, a luminance profile is obtained as described above in connection with FIG. 4. Luminance is then converted to lightness by a cube root function of the luminance, which results in a spatial lightness profile on the retina (e.g., a perceived spatial lightness curve such as curve 403 of FIG. 4). The pixel width corresponding to the 90% percentile to the 10% percentile of the spatial lightness curve may then be determined as the LBEW.

At block 604, the LBEW of the rising grey-to-grey (G2G) transition for a particular set of start and arrival grey levels to be included in the LUT (referred to in FIG. 6 as two tapping points) is measured, using the same techniques described above in connection with the GL0 to GL255 transition but for intermediate start and arrival grey levels (e.g., for an intermediate grey-to-grey transition such as a transition from GL0 to GL32, if GL32 is a tapping point to be stored in the table).

At block 605, processing circuitry of the calibration equipment or device 100 determines whether the measured LBEW of the tapping points is within a range of the target LBEWt (e.g., within LBEWt and LBWEt+1 pixel). If the measured LBEW for the two tapping points is not within the range, a boost value or overdrive value for those tapping points is raised by a predetermined amount (e.g., by one grey level) at block 606. The boost value is zero for the first iteration of the operations associated with blocks 604, 605, and 606. After increasing the boost value, the operations of blocks 604, 605, and 606 are repeated, using the increased boost value to operate the display pixels, until the measured LBEW for that set of tapping points is within the range or until another negative display effect is detected. For example, overboosting may cause a luminance overshoot for one or more pixels in which, at the end of the overdrive frame, the luminance value becomes higher than the target G2G transition value. A luminance overshoot can cause other visible artifacts that can negate the benefits of the boosting to address motion blur and color tails. When, at block 605, the measured LBEW for that set of tapping points is within the range or when a maximum boost value has been determined that does not cause another negative display effect (e.g., luminance overshoot) is identified, the boost value for that set of tapping points is stored in the LUT in association with those tapping points (e.g., as an entry in the table corresponding to a start grey level of GL0 and an arrival grey level of GL32). In this way, the LBEW of an intermediate grey level transition can be matched (to within the range) to the LBEW of the maximum G2G transition or the LBEW of the intermediate grey level transition can be modified to correspond as closely as possible to the LBEW of the maximum G2G transition without causing luminance overshoot or other negative display artifacts.

At block 607, the operations of blocks 604, 605, and 606 are repeated, in a looping portion 650 of the process, for other G2G transitions (e.g., for other pairs of tapping points such as rising grey level transitions to and/or between GL0, GL32, GL64, GL96, GL128, GL160, and GL192, and GL255), until all rising G2G transitions in the table have stored boost values that, when applied, cause the LBEW for that G2G transition to match the GL0-GL255 transition within the desired range (e.g., within one pixel), without causing a luminance overshoot.

At block 608, a blur width such as the BEW of a maximum falling grey-to-grey transition such as the GL255 to GL0 transition, for one or more subpixels, is measured while operating the display at the same frequency of x Hz and at the same temperature of y° C. The measured BEW of the GL255 to GL0 transition is then saved as the target BEW ($BEW_t$). The BEW of the GL255 to GL0 transition may be measured using a single pixel, a single subpixel, a group of contiguous or non-contiguous pixels that form a subset of the array of display pixels, or the entire array of pixels. Measuring the BEW may include applying a voltage corresponding to the first grey level value (GL255) to the one or more pixels or subpixels, then applying the second grey level value (GL0) to the same one or more pixels and measuring the luminance response curve (e.g., see curve 401 of FIG. 4). From the measured luminance response curve, a graph such as graph 402 of FIG. 4 may be generated. Based on the graph 402, a luminance profile is obtained as described above in connection with FIG. 4. The pixel width corresponding to the 10% percentile to the 90% percentile of the spatial luminance curve may then be determined as the BEW.

At block 609, the BEW of the falling grey-to-grey (G2G) transition for a particular set of start and arrival grey levels to be included in the LUT (referred to in FIG. 6 as two tapping points) is measured, using similar techniques to described above in connection with the GL255 to GL0 transition, but for intermediate start and arrival grey levels (e.g., for an intermediate grey-to-grey transition such as a transition from GL255 to GL224, if GL224 is a tapping point to be stored in the table).

At block 610, processing circuitry of the calibration equipment determines whether the measured BEW of the tapping points for the falling G2G transition is within a range of the target $BEW_t$ (e.g., within $BEW_t$ and $BWE_t$+1 pixel). If the measured BEW for the two tapping points is not within the range, a boost value or overdrive value for those tapping points is lowered by a predetermined amount (e.g., by one grey level) at block 611. The boost value is zero for the first iteration of the operations associated with blocks 609, 610, and 611. After decreasing the boost value, the operations of blocks 609, 610, and 611 are repeated, using the decreased boost value to operate the display pixels, until the measured BEW for that set of tapping points is within the range or until another negative display effect is detected. For example, underboosting may cause a luminance undershoot for one or more pixels in which, at the end of the overdrive frame, the luminance value becomes lower than the target G2G transition value. A luminance undershoot can cause other visible artifacts that can negate the benefits of the BEW boosting to address motion blur and color tails. When, at block 610, the measured BEW for that set of tapping points is within the range or when a minimum boost value has been determined that does not cause another negative display effect (e.g., luminance undershoot) is identified, the boost value for that set of tapping points is stored in the LUT in association with those tapping points (e.g., as an entry in the table corresponding to a start grey level of GL255 and an arrival grey level of GL224). In this way, the BEW of an intermediate falling grey level transition can be matched (to within the range) to the BEW of the maximum falling G2G transition or the BEW of the intermediate grey level transition can be modified to correspond as closely as possible to the BEW of the maximum falling G2G transition without causing luminance undershoot or other negative display artifacts.

At block 612, the operations of blocks 609, 610, and 611 are repeated, in a looping portion 660 of the process, for other falling G2G transitions (e.g., for other pairs of tapping points such as falling grey level transitions to and/or between GL255, GL192, GL160, GL128, GL96, GL64, and GL32, and GL0), until all falling G2G transitions in the table have stored boost values that, when applied, cause the BEW for that G2G transition to match the GL255-GL0 transition BEW within the desired range (e.g., within one pixel)), without causing a luminance undershoot.

An example lookup table 613 in which the LBEW-based and BEW-based boost values can be stored is shown in FIG. 6, for a display frequency of x Hz and at display operating temperature of y° C. for an intermediate grey-to-grey transition. The example lookup table 613 includes uniformly spaced tapping points (e.g., at grey levels of 0, 32, 64, etc.) which may apply to an 8-bit display panel. However, it should be appreciated that other grey levels (tapping points) may be used (e.g., for display panels having other bit resolutions) and/or non-uniformly spaced tapping points may be used.

As indicated, a block 614, the operations of blocks 601 through 612 are repeated for other display frequencies and other display operating temperatures until a desired set of lookup tables, each corresponding to a particular display operating frequency and a particular display operating temperature, and each having LBEW-based and BEW-based boost values as described are generated. The set of lookup tables is then stored using system circuity 208 and/or display control circuitry such as GPU 212 and/or timing controller 210 for boost operations (see, e.g., FIG. 5) or display 110.

In accordance with various aspects of the subject disclosure, an electronic device with a display is provided, the display including a plurality of pixels and circuitry electrically coupled with the plurality of pixels. The circuitry includes a lookup table storage and selection module storing a set of lookup tables, each lookup table including at least one boost value that is based on a spatial width associated with a moving edge for display with the plurality of pixels. The circuitry also includes a lookup table value selector to obtain a boost value based on at least one of the set of lookup tables. The circuitry also includes a boost engine to apply the obtained boost value to a display pixel value to be displayed on the display.

In accordance with other aspects of the subject disclosure, a method is provided that includes storing, with a lookup table storage and selection module of display circuitry of an electronic device display, a set of lookup tables, each lookup table including at least one boost value that is based on a spatial width associated with a moving edge for display with a plurality of pixels of the electronic device display. The method also includes obtaining, with a lookup table value selector of the display circuitry, a boost value based on at least one of the set of lookup tables. The method also includes applying, with a boost engine of the display circuitry, the obtained boost value to a display pixel value to be displayed on the electronic device display.

In accordance with other aspects of the subject disclosure, a method is provided that includes measuring, for each of several display operating frequencies and each of several display operating temperatures of an electronic device display, a target spatial blur-width of a moving displayed edge associated with a maximum grey-to-grey transition of the electronic device display. The method also includes determining a plurality of boost values for overdrive of display pixels of the electronic device display, wherein each of the plurality of boost values, when applied, modifies a spatial blur-width of a moving displayed edge associated with an intermediate grey-to-grey transition of the electronic device display based on the spatial blur-width of the moving displayed edge associated with the maximum grey-to-grey transition.

Various functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "processor", and "memory" all refer to electronic or other technological devices. These terms exclude people or groups of people. For the purposes of the specification, the terms "display" or "displaying" means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device as described herein for displaying information to the user and a keyboard and a pointing device, such as a mouse or a trackball, by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. An electronic device with a display, the display comprising:

a plurality of pixels; and circuitry electrically coupled with the plurality of pixels, the circuitry comprising:

a lookup table storage and selection engine storing a set of lookup tables, each lookup table including at least one boost value;

a lookup table value selector to obtain a boost value based on at least one of the set of lookup tables; and a boost engine to apply the obtained boost value to a display pixel value to be displayed on the display, wherein the at least one boost value is based on a spatial width associated with a moving edge for display with the plurality of pixels, and comprises a first boost value configured to match a lightness-blur-edge-width, of a grey-to-grey transition from a previous display pixel value to the display pixel value to be displayed, to a target lightness-blur-edge-width.

2. The electronic device of claim 1, wherein each of the set of lookup tables is associated with an operating frequency and an operating temperature of the display.

3. The electronic device of claim 2, wherein the lookup table storage and selection module is configured to:

determine a current operating frequency of the display; and identify a subset of the set of lookup tables, the subset corresponding to the current operating frequency.

4. The electronic device of claim 3, wherein the lookup table storage and selection module is further configured to:

determine a current operating temperature of the display; and obtain a lookup table based on the current operating temperature and the subset of the set of lookup tables.

5. The electronic device of claim 4, wherein the lookup table storage and selection module is configured to obtain the lookup table based on the current operating temperature and the subset of the set of lookup tables by selecting one of the subset of the set of lookup tables that corresponds to the current operating temperature.

6. The electronic device of claim 4, wherein the lookup table storage and selection module is configured to obtain the lookup table based on the current operating temperature and the subset of the set of lookup tables by generating a new lookup table by interpolating between at least two of the subset of the set of lookup tables.

7. The electronic device of claim 1, wherein the target lightness-blur-edge-width is a measured lightness-blur-edge-width of a maximum rising grey-to-grey transition.

8. The electronic device of claim 7, wherein the measured lightness-blur-edge-width is a width of a spatial decrease in lightness from a ninetieth percentile perceived lightness to a tenth percentile perceived lightness.

9. The electronic device of claim 8, wherein the lightness is based on a combination of a measured luminance curve of at least one display pixel of the display with a human vision pursuit model, and wherein the lightness is a cube root of a luminance.

10. The electronic device of claim 9, wherein the at least one boost value that is based on the spatial width associated with the moving edge for display with the plurality of pixels comprises a second boost value configured to match a blur-edge-width, of a grey-to-grey transition from a previous display pixel value to the display pixel value to be displayed, to a target blur-edge-width.

11. The electronic device of claim 10, wherein the target blur-edge-width is a measured blur-edge-width of a maximum falling grey-to-grey transition.

12. The electronic device of claim 11, wherein the measured blur-edge-width is a width of a spatial increase in luminance from a tenth percentile perceived luminance to a ninetieth percentile perceived luminance.

13. The electronic device of claim 12, wherein the luminance is based on a combination of a measured luminance curve of at least one display pixel of the display with the human vision pursuit model.

14. A method, comprising:

storing, by using a lookup table storage and selection engine of display circuitry of an electronic device display, a set of lookup tables, each lookup table including at least one boost value;

obtaining, by using a lookup table value selector of the display circuitry, a boost value based on at least one of the set of lookup tables; and applying, by using a boost engine of the display circuitry, the obtained boost value to a display pixel value to be displayed on the electronic device display, wherein the at least one boost value is based on a spatial width associated with a moving edge for display with the plurality of pixels, and comprises a first boost value configured to match a lightness-blur-edge-width, of a grey-to-grey transition from a previous display pixel value to the display pixel value to be displayed, to a target lightness-blur-edge-width.

15. The method of claim 14, wherein each of the set of lookup tables is associated with an operating frequency and an operating temperature of the electronic device display.

16. The method of claim 15, further comprising, with the lookup table storage and selection module:

determining a current operating frequency of the electronic device display; and identifying a subset of the set of lookup tables, the subset corresponding to the current operating frequency.

17. The method of claim 16, further comprising, with the lookup table storage and selection module:

determining a current operating temperature of the electronic device display; and obtaining a lookup table based on the current operating temperature and the subset of the set of lookup tables.

18. The method of claim 17, wherein obtaining the lookup table based on the current operating temperature and the subset of the set of lookup tables comprises selecting one of the subset of the set of lookup tables that corresponds to the current operating temperature.

19. The method of claim 17, wherein obtaining the lookup table based on the current operating temperature and the subset of the set of lookup tables comprises generating a new lookup table by interpolating between at least two of the subset of the set of lookup tables.

20. The method of claim 14, wherein the at least one boost value that is based on a spatial width associated with the moving edge for display with the plurality of pixels of the electronic device display comprises a first boost value configured to match a lightness-blur-edge-width, of a grey-to-grey transition from a previous display pixel value to the display pixel value to be displayed, to a target lightness-blur-edge-width.

21. The method of claim 20, wherein the target lightness-blur-edge-width is a measured lightness-blur-edge-width of a maximum rising grey-to-grey transition.

22. The method of claim 21, wherein the measured lightness-blur-edge-width is a width, in pixels, of a spatial decrease in lightness from a ninetieth percentile perceived lightness to a tenth percentile perceived lightness.

23. The method of claim 22, wherein the lightness is based on a combination of a measured luminance curve of at least one display pixel of the electronic device display with a human vision pursuit model, and wherein the lightness is a cube root of a luminance.

24. The method of claim 23, wherein the at least one boost value that is based on the spatial width associated with the moving edge for display with the plurality of pixels comprises a second boost value configured to match a blur-edge-width, of a grey-to-grey transition from a previous display pixel value to the display pixel value to be displayed, to a target blur-edge-width.

25. The method of claim 24, wherein the target blur-edge-width is a measured blur-edge-width of a maximum falling grey-to-grey transition.

26. The method of claim 25, wherein the measured blur-edge-width is a width, in pixels, of a spatial increase in luminance from a tenth percentile perceived luminance to a ninetieth percentile perceived luminance.

27. The method of claim 26, wherein the luminance is a combination of a measured luminance curve of at least one display pixel of the electronic device display with the human vision pursuit model.

28. A method comprising:

measuring, for each of several display operating frequencies and each of several display operating temperatures of an electronic device display, a target spatial blur-width of a moving displayed edge associated with a maximum grey-to-grey transition of the electronic device display; and determining a plurality of boost values for overdrive of display pixels of the electronic device display, wherein each of the plurality of boost values, when applied, modifies a spatial blur-width of a moving displayed edge associated with an intermediate grey-to-grey transition of the electronic device display based on the spatial blur-width of the moving displayed edge associated with the maximum grey-to-grey transition.

29. The method of claim 28, wherein the maximum grey-to-grey transition and the intermediate grey-to-grey transition are rising grey-to-grey transitions, the method further comprising:

measuring, for each of the several display operating frequencies and each of the several display operating temperatures of the electronic device display, a target spatial blur-width of a moving displayed edge associated with a maximum falling grey-to-grey transition of the electronic device display; and determining an additional plurality of boost values for overdrive of display pixels of the electronic device display, wherein each of the additional plurality of boost values, when applied, modifies a spatial blur-width of an intermediate falling grey-to-grey transition of the electronic device display based on the spatial blur-width of the maximum falling grey-to-grey transition.

* * * * *